US008256864B2

(12) United States Patent
Kaneko

(10) Patent No.: US 8,256,864 B2
(45) Date of Patent: Sep. 4, 2012

(54) LIQUID EJECTING APPARATUS AND CONTROL METHOD THEREOF

(75) Inventor: Tomoshige Kaneko, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 12/940,258

(22) Filed: Nov. 5, 2010

(65) Prior Publication Data

US 2011/0148962 A1 Jun. 23, 2011

(30) Foreign Application Priority Data

Dec. 21, 2009 (JP) ..... 2009-288747

(51) Int. Cl.
*B41J 29/38* (2006.01)

(52) U.S. Cl. ..... 347/14; 347/10; 347/16; 347/19

(58) Field of Classification Search ..... 347/14, 347/10, 16, 19
See application file for complete search history.

(56) References Cited

U.S. PATENT DOCUMENTS

| | | | | |
|---|---|---|---|---|
| 2003/0117454 | A1* | 6/2003 | Junhua et al. | 347/19 |
| 2011/0090272 | A1* | 4/2011 | Matsuo | 347/10 |
| 2011/0090274 | A1* | 4/2011 | Otsuka et al. | 347/10 |
| 2011/0096111 | A1* | 4/2011 | Matsuo | 347/10 |
| 2011/0096112 | A1* | 4/2011 | Matsuo | 347/10 |

FOREIGN PATENT DOCUMENTS

| | | |
|---|---|---|
| JP | 2004-243661 | 9/2004 |

* cited by examiner

*Primary Examiner* — Laura Martin
(74) *Attorney, Agent, or Firm* — Workman Nydegger

(57) ABSTRACT

A return component that gently expands the volume of the pressure generating chamber, wherein a time interval of the expansion component is longer than that of the expansion holding component, and a time interval of the return component is longer than that of the contraction holding component, wherein a first reference potential is set to be 50% or more of the potential of the contraction holding component, and wherein when the ejection driving pulse is applied to a piezoelectric oscillator, a flow rate of the ink ejected from the nozzle opening is 0.36 mg/s or more.

3 Claims, 9 Drawing Sheets

FIG. 9

| | DEAERATION DEGREE (CARTRIDGE) | | | |
|---|---|---|---|---|
| WAVEFORM | IMMEDIATELY AFTER | 2W SATURATION | 1M SATURATION | 3M SATURATION |
| DP1 (WAVEFORM WHICH IS COUNTERMEASURE) | ○ | ○ | ○ | △ |
| DP2 (WAVEFORM WHICH IS NOT COUNTERMEASURE) | ○ | ○ | × | × |

LIQUID EJECTING APPARATUS AND CONTROL METHOD THEREOF

The entire disclosure of Japanese Patent Application No: 2009-288747, filed Dec. 21, 2009 are expressly incorporated by reference herein.

BACKGROUND

1. Technical Field

The present invention relates to a liquid ejecting apparatus equipped with a liquid ejecting head such as an ink jet printing head, and a control method thereof.

2. Related Art

A liquid ejecting apparatus is an apparatus that includes a liquid ejecting head capable of ejecting a liquid and ejects various types of liquids from the liquid ejecting head. As a typical example of the liquid ejecting apparatus, for example, an image forming apparatus such as an ink jet printer (hereinafter, simply referred to as a printer) that includes an ink jet printing head (hereinafter, simply referred to as a printing head) as a liquid ejecting head and prints an image or the like by ejecting and landing a liquid-drop-shaped ink from a nozzle of the printing head onto a printing medium (ejection target) such as a printing sheet may be exemplified. In recent years, the application of the liquid ejecting apparatus has not been limited to the image forming apparatus, and the liquid ejecting apparatus has been applied to various manufacturing apparatuses. For example, in an apparatus for manufacturing a display such as a liquid crystal display, a plasma display, an organic EL (Electro Luminescence) display, or an FED (Field Emission Display), the liquid ejecting apparatus has been used in order to eject various liquid materials such as a color material or an electrode onto a pixel formation area or an electrode formation area.

The printing head includes a channel unit to which ink is introduced from a liquid storing portion such as an ink cartridge enclosing liquid ink therein and which is provided with a series of liquid channels formed from a reservoir to a nozzle via a pressure chamber or an actuator unit which has a pressure generating element capable of changing the volume of the pressure chamber. In the printing head, the speed of ejecting the ink from the nozzle can be made faster as a variation in the pressure generated by the pressure generating element becomes larger. However, if a larger variation in the pressure is applied to the pressure chamber, a negative pressure occurs when the liquid passes through a diameter-reduced portion of the liquid channels, and hence cavitation occurs due to the negative pressure, which may generate bubbles in the ink. As a result, since a pressure loss is caused by the bubbles mixed with the ink and absorbing a variation in the pressure, so-called dot skipping may be caused when no ink is ejected from the nozzle or a flying path may be curved, thereby causing a problem that ink ejection errors occur in the printing head.

In order to suppress the cavitation causing the ejection errors of the ink, various maintenance processes are carried out. For example, JP-A-2004-243661 discloses a printer capable of suppressing the occurrence of the cavitation due to the negative pressure generated when the pressure chamber is abruptly expanded by providing any one or both of a short driving pulse having a voltage equivalent to that of an expansion pulse before the expansion pulse for deforming the volume of the pressure chamber from the normal state as the reference of a variation in the volume to the expansion state and a short driving pulse having a voltage equivalent to that of a contraction pulse after the contraction pulse for deforming the volume of the pressure chamber from the contraction state to the normal state.

However, in the printer having a configuration in which the potential of the short driving pulse and the potential of the short idle period are changed by a switch, when a difference between the potential of the short driving pulse and the potential of the short idle period is set to be larger, the pressure chamber is abruptly deformed. Due to the abrupt variation in the pressure chamber, it is difficult to reliably suppress the cavitation generated by the negative pressure inside the liquid channel. As a result, the bubbles generated by the cavitation stay inside the liquid channel, and the bubbles absorb a variation in the pressure, thereby causing the problem of the ejection errors.

SUMMARY

An advantage of some aspects of the invention is that it provides a liquid ejecting apparatus capable of preventing ejection errors resulting from bubbles by suppressing the occurrence of cavitation inside a liquid channel, and a control method thereof.

An aspect of the invention provides a liquid ejecting apparatus including: a liquid ejecting head that applies a variation in the pressure to the inside of a pressure chamber by operating a pressure generating unit and ejects a liquid filled in the pressure chamber from a nozzle; and a driving signal generating unit that is capable of generating a driving signal containing an ejection driving pulse for ejecting the liquid from the nozzle to a landing target by driving the pressure generating unit, wherein the ejection driving pulse is a voltage waveform including: a first changing portion that changes a potential from a middle potential in a first direction so as to change a volume of the pressure chamber; a first holding portion that holds a terminal potential of the first changing portion so as to hold the volume of the pressure chamber for a predetermined time; a second changing portion that changes the potential in a second direction opposite to the first direction so as to change the volume of the pressure chamber subjected to the first changing portion; a second holding portion that holds a terminal potential of the second changing portion so as to hold the volume of the pressure chamber for a predetermined time; and a third changing portion that returns the potential to the middle potential in the first direction so as to change the volume of the pressure chamber subjected to the second changing portion, wherein a time interval of the first changing portion is longer than that of the first holding portion, wherein a time interval of the third changing portion is longer than that of the second holding portion, wherein the middle potential is set to be 50% or more of the potential of the second holding portion, and wherein when the ejection driving pulse is applied to the pressure generating unit, a flow rate of the liquid ejected from the nozzle is 0.36 mg/s or more.

According to the above-described configuration, the ejection driving pulse is a voltage waveform including: a first changing portion that changes a potential from a middle potential in a first direction so as to change a volume of the pressure chamber; a first holding portion that holds a terminal potential of the first changing portion so as to hold the volume of the pressure chamber for a predetermined time; a second changing portion that changes the potential in a second direction opposite to the first direction so as to change the volume of the pressure chamber subjected to the first changing portion; a second holding portion that holds a terminal potential of the second changing portion so as to hold the volume of the pressure chamber for a predetermined time; and a third changing portion that returns the potential to the middle potential in the first direction so as to change the volume of the pressure chamber subjected to the second changing portion, wherein a time interval of the first changing portion is longer than that of the first holding portion, wherein a time interval of the third changing portion is longer than that of the second holding portion, wherein the middle potential is set to be 50% or more of the potential of the second holding portion, and wherein when the ejection driving pulse is applied to the pressure generating unit, a flow rate of the liquid ejected from the nozzle is 0.36 mg/s or more. Accordingly, since it is possible to deform the pressure chamber gently when a variation in the pressure is caused inside the pressure chamber so as to eject the liquid from the nozzle, it is possible to reduce a negative pressure generated inside the liquid channel while ensuring the flow rate necessary for the ejection of the liquid. Therefore, since it is possible to suppress the occurrence of the cavitation resulting from the negative pressure, it is possible to reduce the bubbles inside the liquid channel with the occurrence of the cavitation. As a result, it is possible to prevent the occurrence of the ejection errors such as dot skipping or curved flying path caused by the bubbles staying inside the liquid channel.

Further, in the above-described configuration, the amount of nitrogen dissolved in a liquid filled in a liquid cartridge attached to the liquid ejecting apparatus may be 7.0 ppm or more.

Even when the amount of nitrogen dissolved in the liquid filled in the liquid cartridge is less than 7.0 ppm, if the flow rate of the liquid ejected from the nozzle is 0.36 mg/s or more and the ejection driving pulse having the first shape is used, it is possible to suppress the occurrence of cavitation resulting from the negative pressure. On the other hand, when a deaeration degree of the liquid inside the liquid cartridge is gradually decreased in accordance with the elapsing time from the time point when the liquid cartridge is first used or when the deaeration degree of the liquid inside the liquid cartridge is lower than that of the time point when the liquid cartridge is first used due to a difference between the manufacturing environment and the usage environment, the amount of nitrogen dissolved in the liquid filled in the liquid cartridge may be 7.0 ppm or more. In this case, since the amount of nitrogen dissolved in the liquid is large, cavitation easily occurs. Even in this case, when the ejection driving pulse having the first shape is used, it is possible to suppress the occurrence of the cavitation resulting from the negative pressure generated inside the liquid channel. Accordingly, it is possible to prevent the occurrence of the ejection errors resulting from the bubbles inside the liquid channel with the occurrence of the cavitation.

Further, another aspect of the invention provides a control method of a liquid ejecting apparatus including: a liquid ejecting head that applies a variation in the pressure to the inside of a pressure chamber by operating a pressure generating unit and ejects a liquid filled in the pressure chamber from a nozzle; and a driving signal generating unit that is capable of generating a driving signal containing an ejection driving pulse for ejecting the liquid from the nozzle to a landing target by driving the pressure generating unit, the ejection driving pulse being a voltage waveform including: a first changing portion changing a potential from a middle potential in a first direction; a first holding portion holding a terminal potential of the first changing portion; a second changing portion changing the potential in a second direction opposite to the first direction; a second holding portion holding a terminal potential of the second changing portion; and a third changing portion returning the potential to the middle potential in the first direction, the middle potential being set to be 50% or more of the potential of the second holding portion, the control method including: changing a volume of the pressure chamber by the first changing portion; holding the volume of the pressure chamber subjected to the first changing portion for a predetermined time by the first holding portion; changing the volume of the pressure chamber subjected to the first changing portion by the second changing portion; holding the volume of the pressure chamber subjected to the second changing portion for a predetermined time by the second holding portion; and changing the volume of the pressure chamber subjected to the second changing portion by the third changing portion, wherein a time interval of the first changing is longer than that of the first holding, wherein a time interval of the third changing is longer than that of the second holding, and wherein a flow rate of the liquid ejected from the nozzle and subjected to the changing and holding is 0.36 mg/s or more.

According to the control method, since it is possible to deform the pressure chamber gently when a variation in the pressure inside the pressure chamber is caused so as to eject the liquid from the nozzle, it is possible to reduce a negative pressure generated inside the liquid channel while ensuring the flow rate necessary for the ejection of the liquid. Therefore, since it is possible to suppress the occurrence of the cavitation resulting from the negative pressure, it is possible to reduce the bubbles inside the liquid channel with the occurrence of the cavitation. As a result, it is possible to prevent the occurrence of the ejection errors such as dot skipping or curved flying path caused by the bubbles staying inside the liquid channel.

BRIEF DESCRIPTION OF THE DRAWINGS

The invention will be described with reference to the accompanying drawings, wherein like numbers reference like elements.

FIG. 9 is a diagram illustrating a relationship between a deaeration degree of an ink cartridge and dot skipping.

DESCRIPTION OF EXEMPLARY EMBODIMENTS

Figure 1:
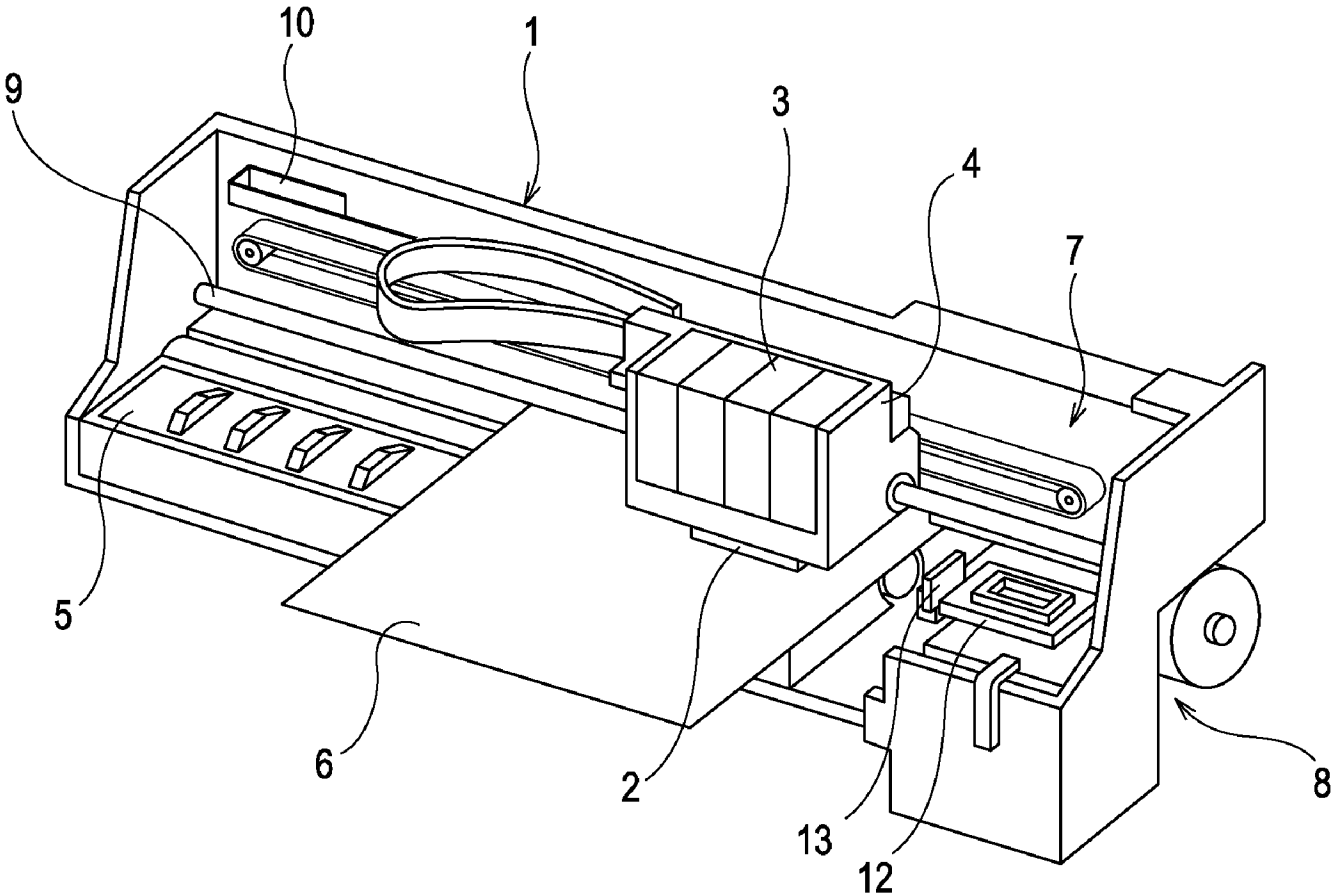
FIG. 1 is a perspective view illustrating a schematic configuration of a printer.

Hereinafter, exemplary embodiments of the invention will be described with reference to the accompanying drawings. In addition, in the exemplary embodiments to be described below, it should be understood that various preferred embodiments of the invention are not to be considered as limiting if there is no particular remark to limit the invention. Further, in the description below, an ink jet printing apparatus (hereinafter, simply referred to as a printer) shown in FIG. 1 is exemplified as the liquid ejecting apparatus of the invention.

A printer 1 schematically includes a carriage 4 to which a printing head 2 as a kind of liquid ejecting head is attached and to which an ink cartridge 3 (a kind of a liquid cartridge of the invention) storing ink (a kind of liquid of the invention) is detachably attached; a platen 5 which is disposed below the printing head 2; a carriage moving mechanism 7 which moves the carriage 4 mounted with the printing head 2 in the paper width direction of a printing sheet 6 (a kind of a landing target); and a sheet transporting mechanism 8 which transports the printing sheet 6 in the sheet transporting direction as a direction perpendicular to the paper width direction. Here, the paper width direction is a primary scanning direction (head scanning direction), and the sheet transporting direction is a secondary scanning direction (that is, a direction perpendicular to the head scanning direction).

The carriage 4 is attached while being axially supported to a guide rod 9 that is installed in the primary scanning direction, and is adapted to move in the primary scanning direction along the guide rod 9 by the operation of the carriage moving mechanism 7. The position of the carriage 4 in the primary scanning direction is detected by a linear encoder 10, and a detection signal is transmitted to a control unit 46 (refer to FIG. 4) as position information. Accordingly, the control unit 46 is capable of controlling a printing operation (ejecting operation) using the printing head 2 while recognizing the scanning position of the carriage 4 (printing head 2) on the basis of position information obtained from the linear encoder 10.

A home position as a start position of a scanning operation is set in the end portion area on the outside (the right of FIG. 1) of the printing area within the movement range of the carriage 4. A capping member 12 that seals a nozzle formation surface (nozzle plate 36: refer to FIG. 3) of the printing head 2 and a wiper member 13 that wipes the nozzle formation surface are disposed at the home position of the embodiment. Then, the printer 1 is configured to perform a bidirectional printing process of printing characters, images, or the like on the printing sheet 6 in both directions when the carriage 4 (printing head 2) moves forward from the home position to the opposite end portion and moves backward from the opposite end portion to the home position.

Figure 2:
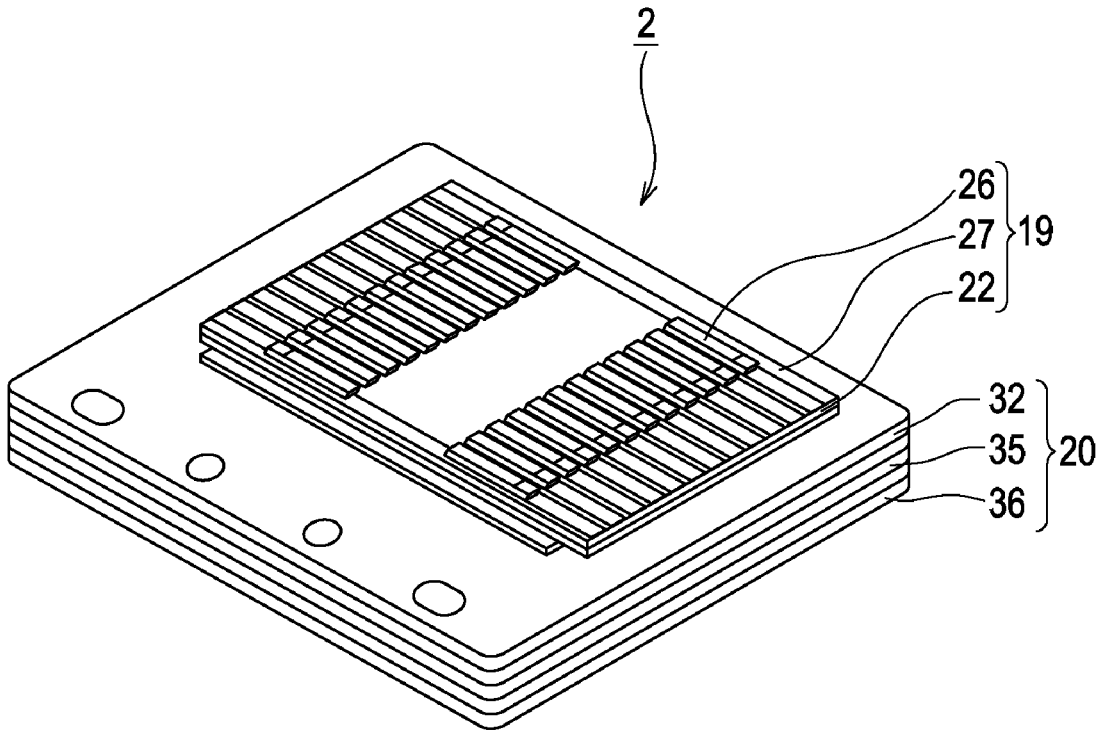
FIG. 2 is a perspective view illustrating a printing head when seen from the side of a pressure generating unit.
Figure 3:
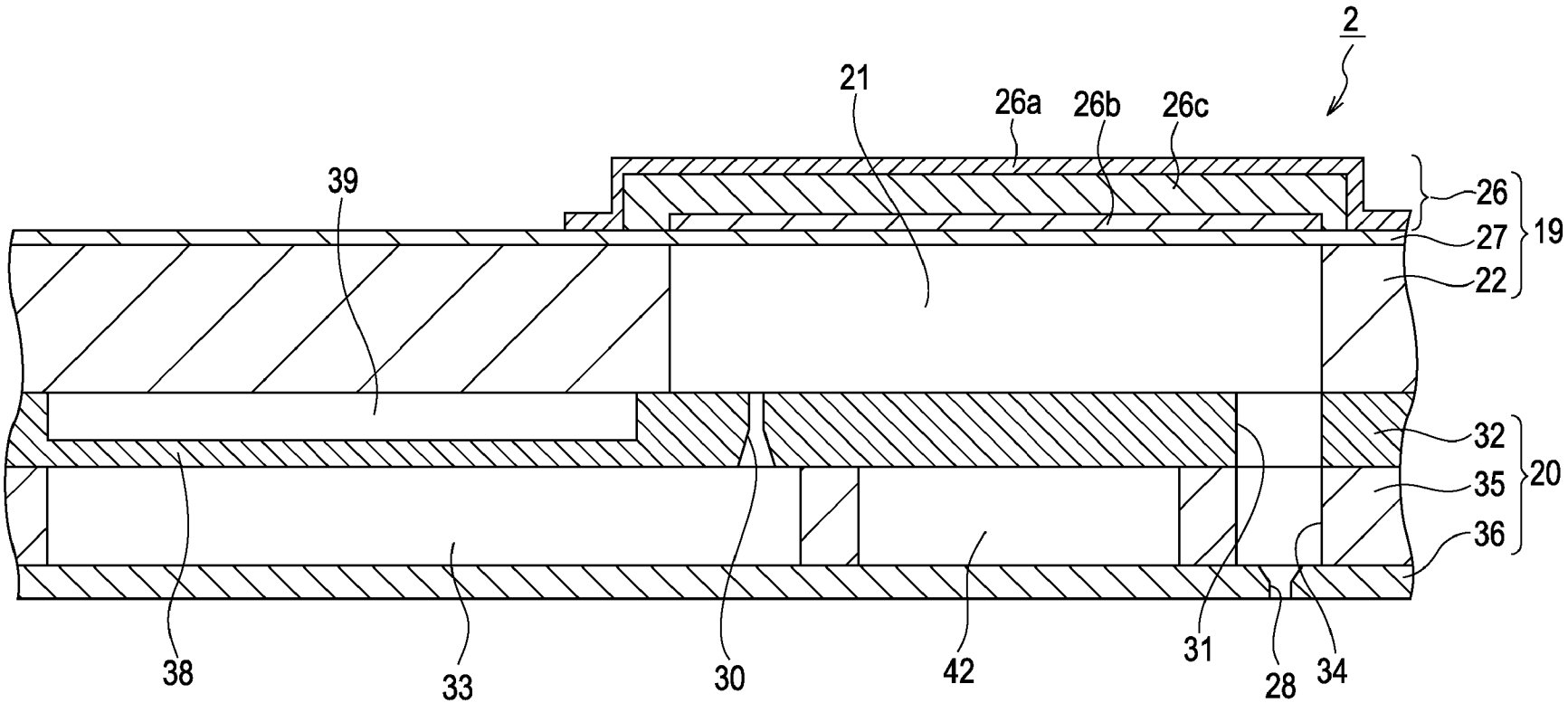
FIG. 3 is a cross-sectional view illustrating a configuration of a main part of the printing head.

Next, the configuration of the printing head 2 will be described. Here, FIG. 2 is a perspective view illustrating the printing head 2 when seen from the side of a pressure generating unit, and FIG. 3 is a cross-sectional view illustrating a main part of the printing head 2. The exemplified printing head 2 includes a pressure generating unit (or an actuator unit) 19 and a channel unit 20, which are integrated with each other in an overlapped state. The pressure generating unit 19 is formed in such a manner that a piezoelectric oscillator 26 (corresponding to a pressure generating unit of the invention), an oscillation plate 27, and a pressure generating chamber plate 22 for defining a pressure generating chamber 21 (corresponding to a pressure chamber of the invention) are laminated and integrated by burning or the like.

Further, the channel unit 20 is formed by laminating a supply port formation plate 32 that forms a supply port 30 or a second communication port 31, and a reservoir plate 35 provided with a reservoir 33 and a first communication port 34. In addition, a nozzle plate 36 provided with a nozzle opening 28 (corresponding to a nozzle of the invention) is provided on the surface of the reservoir plate 35 opposite to the supply port formation plate 32.

The oscillation plate 27 is formed by a plate member having elasticity. A plurality of piezoelectric oscillators 26 is disposed on the outer surface of the oscillation plate 27 on the opposite side of the pressure generating chamber 21 so as to respectively correspond to the pressure generating chambers 21. The exemplified piezoelectric oscillator 26 is a bending oscillation type oscillator, and includes a driving electrode 26*a*, a common electrode 26*b*, and a piezoelectric body 26*c* disposed therebetween. Then, when a driving signal is applied to the driving electrode of the piezoelectric oscillator 26, an electric field is generated between the driving electrode 26*a* and the common electrode 26*b* due to a difference in potential. The electric field is applied to the piezoelectric body 26*c*, and the piezoelectric body 26*c* is deformed in accordance with the magnitude of the applied electric field.

The pressure generating chamber plate 22 is formed by a thin ceramic plate having a thickness suitable for forming the pressure generating chamber 21, and is formed of, for example, alumina or zirconium, where a void portion for defining the pressure generating chamber 21 is formed to perforate the pressure generating chamber plate in the thickness direction. The pressure generating chamber 21 is installed in a line while having the same pitch as that of the nozzle opening 28 of the nozzle plate 36, and is a hole which is thin and long in the left/right direction perpendicular to the arrangement direction.

As shown in FIG. 3, the supply port formation plate 32 is a thin plate-shaped member that is formed of metal such as stainless steel. The supply port formation plate 32 has a plurality of support ports 30 that is formed to perforate the plate in the thickness direction. In addition, the second communication port 31 perforating the plate in the thickness direction is formed to correspond to the first communication port 34 of the reservoir plate 35. The supply port 30 is a portion that gives fluid resistance (flow resistance) to ink inside the ink channel (liquid channel). Regarding the supply port 30, the diameter on the side of the reservoir 33 is widened more than that on the side of the pressure generating chamber 21. The supply port 30 is formed by a pressing process. In addition, the supply port formation plate 32 is provided with a compliance portion 38 that is sufficiently thinner than other portions. The compliance portion 38 is formed in such a manner that a concave portion 39 is formed by cutting in the thickness direction of the plate an area corresponding to the reservoir 33 of the reservoir plate 35 from the surface opposite to the reservoir 33 by an etching process or the like.

The reservoir plate 35 is a plate-shaped member that is formed of metal such as stainless steel. The reservoir plate 35 is provided with a void portion which perforates the plate in the thickness direction so as to define the reservoir 33. The void portion defines the reservoir 33. The reservoir 33 is a portion that serves as a liquid chamber used in common by the plurality of pressure generating chambers 21, is provided for each color ink, and stores ink supplied from the ink cartridge 3 therein. In addition, a plurality of the first communication ports 34 is formed while perforating the reservoir plate 35 in the thickness direction so as to correspond to the second communication ports 31.

The nozzle plate 36 is a plate-shaped member that is formed of metal such as stainless steel. In the nozzle plate 36, nozzle lines (nozzle opening groups), formed by arranging a plurality of nozzle openings 28 in a line, are formed to be parallel in the transverse direction, and in the embodiment, the nozzle lines are formed by 180 nozzle openings 28 installed at the same pitch (for example, 180 dpi). In addition, the nozzle plate 36 may be formed of an organic plastic film or the like instead of metal.

Then, the plate members are integrated by bonding the pressure generating unit 19 to the supply port formation plate 32, bonding the supply port formation plate 32 to the reservoir plate 35, and bonding the reservoir plate 35 to the nozzle plate 36. Accordingly, as shown in FIG. 3, the reservoir 33 communicates with the other end portion of the pressure generating chamber 21 via the supply port 30. In addition, one end portion of the pressure generating chamber 21 communicates with the nozzle opening 28 via the first communication port 34 of the reservoir plate 35 and the second communication port 31 of the supply port formation plate 32. Then, a series of ink channels (liquid channels) communicating from the reservoir 33 to the pressure generating unit 19 and the nozzle opening 28 via the pressure generating chamber 21 are provided for respective nozzle openings 28.

In the printing head 2 with the above-described configuration, the piezoelectric oscillator 26 is deformed to contract or expand the corresponding pressure generating chamber 21 and to cause a variation in the pressure of ink inside the pressure generating chamber 21. By controlling the ink pressure, ink can be ejected from the nozzle opening 28. When the pressure generating chamber 21 having a normal volume is preliminarily expanded before the ejection of ink, the ink is supplied from the reservoir 33 into the pressure generating chamber 21 via the supply port 30. In addition, when the pressure generating chamber 21 is abruptly contracted after the preliminary expansion, the ink is ejected from the nozzle opening 28.

Next, the electrical configuration of the printer 1 will be described.

Figure 4:
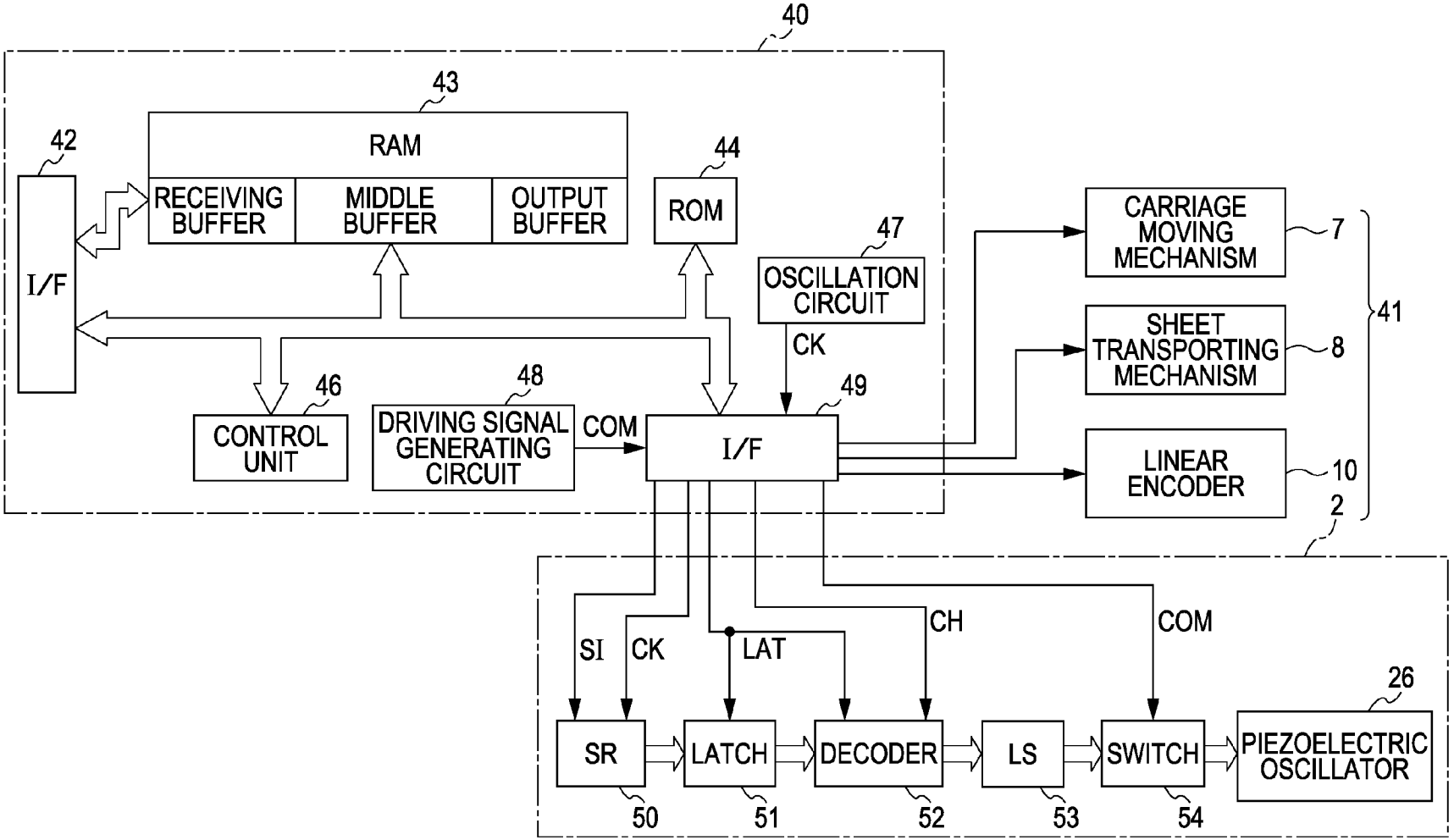
FIG. 4 is a block diagram illustrating an electrical configuration of the printer.

FIG. 4 is a block diagram illustrating an electrical configuration of the printer 1. The printer 1 of the embodiment schematically includes a printer controller 40 and a print engine 41. The printer controller 40 includes an external interface (external I/F) 42 to which print data or the like is input from an external device such as a host computer; a RAM 43 which stores various data or the like; a ROM 44 which stores a control routine or the like for performing various data processes; a control unit 46 which performs a control of respective units; an oscillation circuit 47 which generates a clock signal; a driving signal generating circuit 48 (corresponding to a driving signal generating unit of the invention) which generates a driving signal COM to be supplied to the printing head 2; and an internal interface (internal I/F) 49 which outputs the driving signal or pixel data obtained by performing the print data for each dot to the printing head 2.

The control unit 46 outputs a head control signal for controlling the operation of the printing head 2 to the printing head 2 or outputs a control signal for creating a driving signal COM to the driving signal generating circuit 48. The head control signal includes, for example, a transmission clock CLK, pixel data SI, a latch signal LAT, and a change signal CH1. The latch signal or the change signal defines the supply timing of each pulse constituting the driving signal COM.

Further, the control unit 46 creates pixel data SI used for the ejection control of the printing head 2 through a color conversion process of converting an RGB color system into a CMY color system, a halftone process of reducing multiple tones of data into predetermined tones of data, and a dot pattern development process of developing the halftoned data into dot pattern data so as to be disposed in a predetermined arrangement for each type of the ink (for each nozzle row) based on the print data. The pixel data SI is data for the pixel of the image to be printed, and is a kind of ejection control information. Here, the pixel indicates the dot formation area that is imaginarily determined on the printing medium such as a printing sheet as a landing target. Then, the pixel data SI according to the embodiment includes grayscale data related to the size of the dot (or the ejection amount of ink) and the existence/non-existence of the dot formed on the printing medium (or the ejection/non-ejection of the ink). In the embodiment, the pixel data SI includes two bits of binary grayscale data in total. The two bits of grayscale values include "00" that corresponds to a non-printing process (non-vibration) where no ink is ejected from the nozzle, "01" that corresponds to a small-dot printing process, "10" that corresponds to a middle-dot printing process, and "11" that corresponds to a large-dot printing process. Accordingly, the printer of the embodiment is capable of performing a printing process with four grayscales.

Next, the configuration of the print engine 41 will be described. The print engine 41 includes the printing head 2, the carriage moving mechanism 7, the sheet transporting mechanism 8, and the linear encoder 10. The printing head 2 includes shift registers (SRs) 50, latches 51, decoders 52, level shifters (LSs) 53, switches 54, and piezoelectric oscillators 26, which are respectively provided to correspond to the nozzle openings 28. The pixel data (SI) output from the printer controller 40 is transmitted in serial to the shift register 50 while being synchronized with the clock signal (CK) output from the oscillation circuit 47.

The latch 51 is electrically connected to the shift register 50, and hence when the latch signal (LAT) is input from the printer controller 40 to the latch 51, the pixel data of the shift register 50 is latched. The pixel data latched by the latch 51 is input to the decoder 52. The decoder 52 creates pulse selection data from two bits of pixel data. The pulse selection data of the embodiment includes two bits of data in total.

Then, the decoder 52 outputs the pulse selection data to the level shifter 53 when receiving the latch signal (LAT) or the channel signal (CH). In this case, the pulse selection data is input to the level shifter 53 in an order from the high level bit. The level shifter 53 functions as a voltage amplifier, and outputs a voltage capable of driving the switch 54, for example, an electrical signal boosted to several tens of volts when the pulse selection data is "1". The pulse selection data of "1" boosted by the level shifter 53 is supplied to the switch 54. The driving signal COM output from the driving signal generating circuit 48 is supplied to the input side of the switch 54, and the piezoelectric oscillator 26 is connected to the output side of the switch 54.

Then, the pulse selection data controls the operation of the switch 54, that is, the supply of the ejection pulse of the driving signal to the piezoelectric oscillator 26. For example, the switch 54 enters a connection state during a time when the pulse selection data input to the switch 54 is "1", and the corresponding ejection pulse is supplied to the piezoelectric oscillator 26, thereby changing the potential level of the piezoelectric oscillator 26 in accordance with the waveform of the ejection pulse. On the other hand, the electrical signal for operating the switch 54 is not output from the level shifter 53 during a time when the pulse selection data is "0". For this reason, the switch 54 enters a disconnection state, and the ejection pulse is not supplied to the piezoelectric oscillator 26.

Here, the bubbles existing in the ink inside the ink channel of the printing head 2 will be described. The ink cartridge 3 is usually subjected to a deaeration process of removing air from the ink during the manufacturing process. However, when the ink cartridge 3 is attached to the printer 1, air (which is mainly nitrogen) enters the ink channel while permeating a wall surface or the like of the ink channel with the elapsing of time so that the air dissolves in the ink or the bubbles are mixed with the ink. Alternatively, since the manufacturing environment and the use environment of the ink cartridge 3 are different, the concentration of nitrogen in the ink increases so that the amount of dissolved nitrogen is 7.0 ppm or more, whereby the deaeration degree decreases. When an abrupt variation in the pressure is applied to the pressure generating chamber 21 filled with the ink having a decreased deaeration degree, a negative pressure is generated inside the ink channel, and thus there is a tendency that cavitation easily occurs due to the negative pressure. Then, when the bubbles generated inside the ink channel grow due to the occurrence of the cavitation, the grown bubbles absorb a variation in the pressure. Accordingly, ejection errors may occur, such as a so-called dot skipping caused when no ink is ejected from the nozzle opening 28 or a curved flying path. For this reason, the ejection driving pulse DP1 of the printer 1 of the invention includes a series of waveform components that are used to eject the ink from the nozzle opening 28 by applying a variation in the pressure to the pressure generating chamber 21 so that the pressure generating chamber 21 is gradually deformed (expanded), which prevents the occurrence of the cavitation caused by the negative pressure generated inside the ink channel when the ejection pulse is applied to the piezoelectric oscillator 26.

Figure 5:
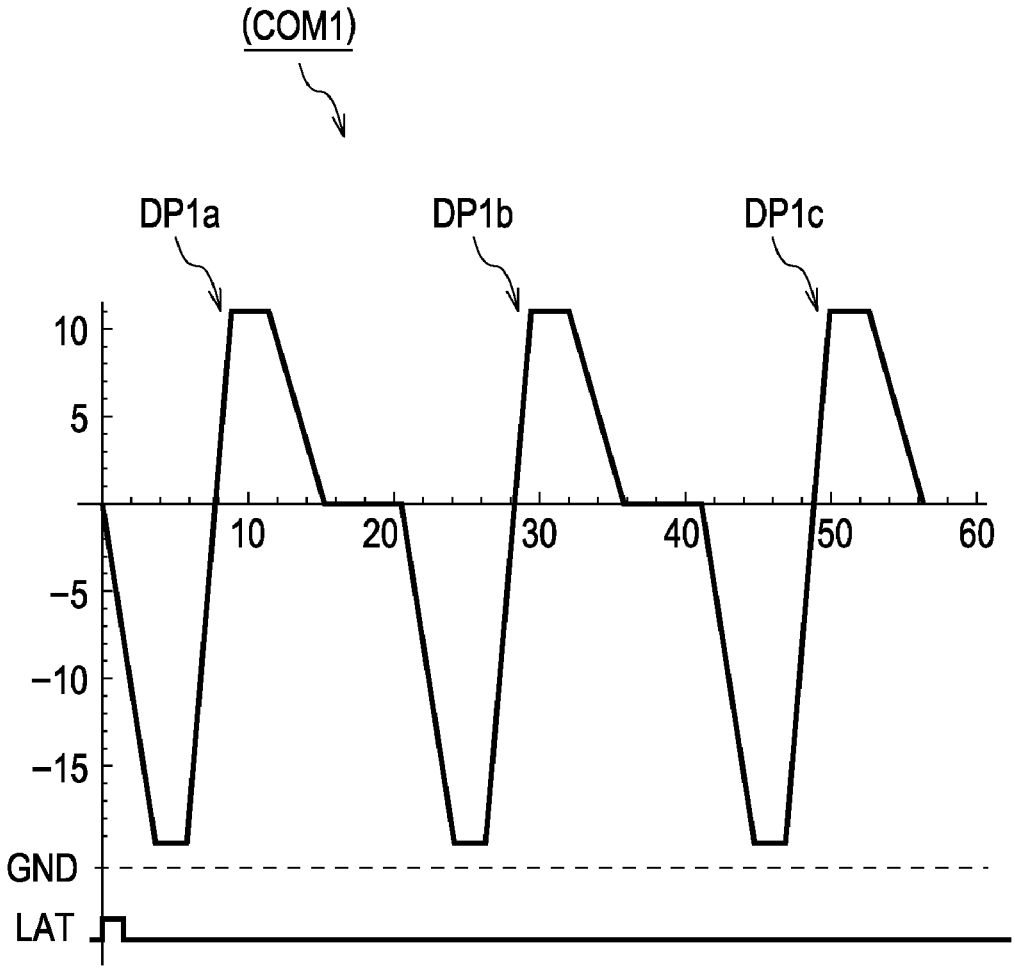
FIG. 5 is a waveform diagram illustrating a configuration of a driving signal containing an ejection driving pulse.
Figure 6:
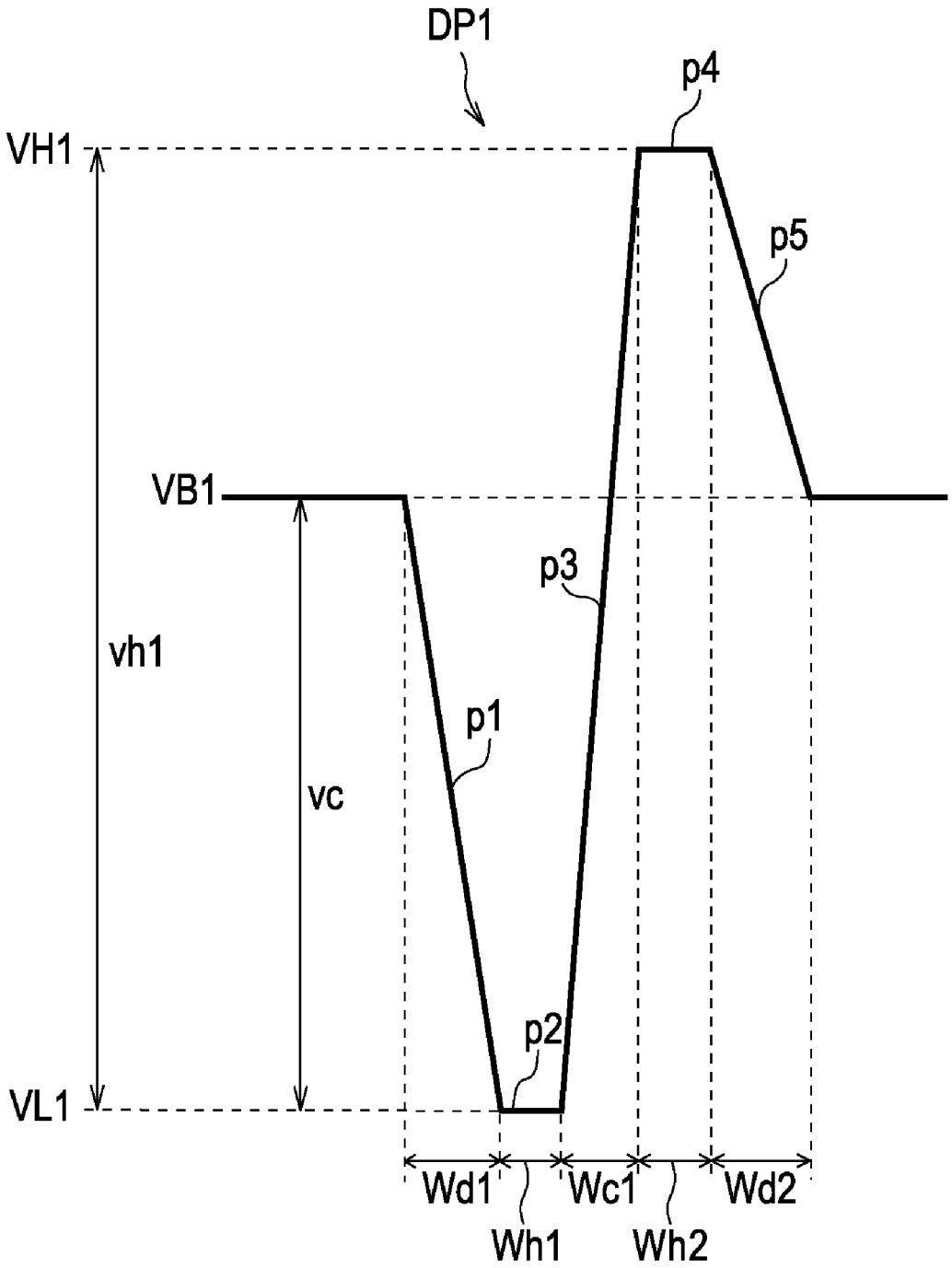
FIG. 6 is a waveform diagram illustrating a configuration of the ejection driving pulse.
Figure 7:
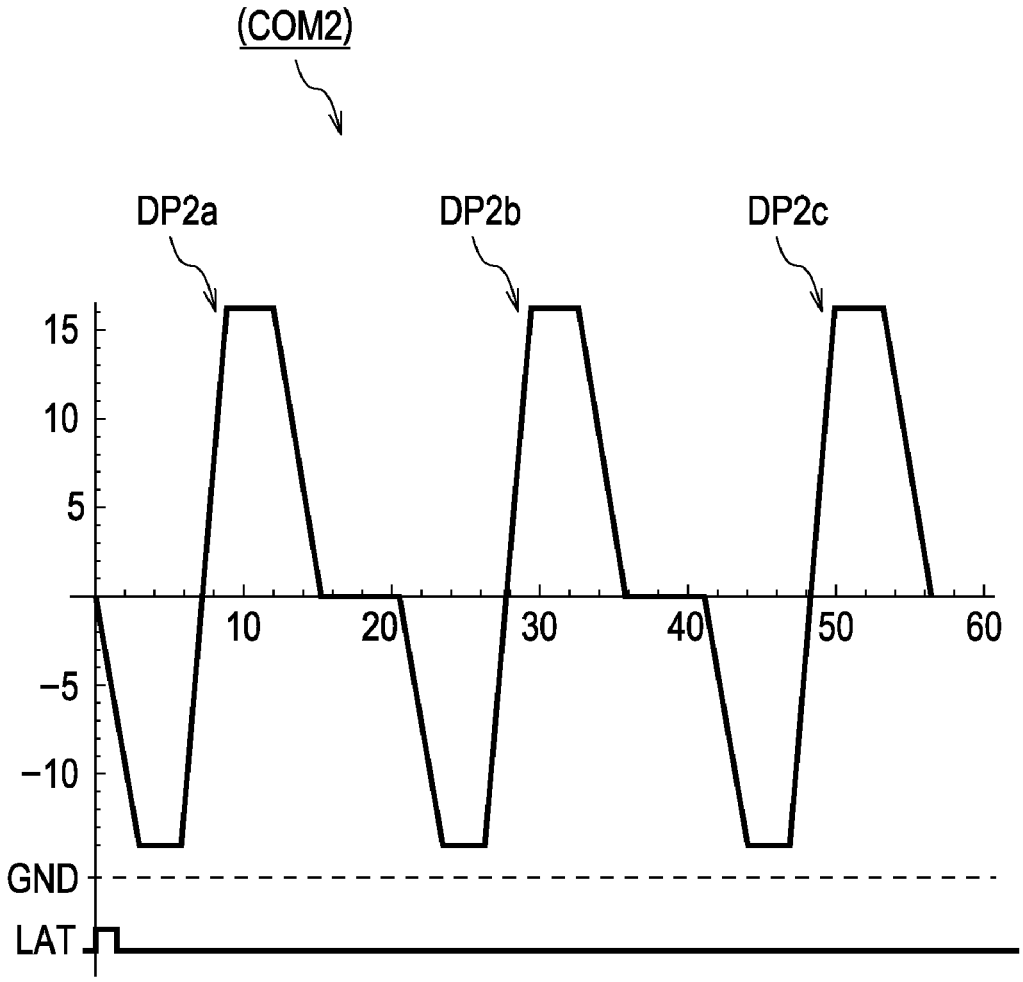
FIG. 7 is a waveform diagram illustrating a configuration of the driving signal containing the ejection driving pulse according to a comparative example.
Figure 8:
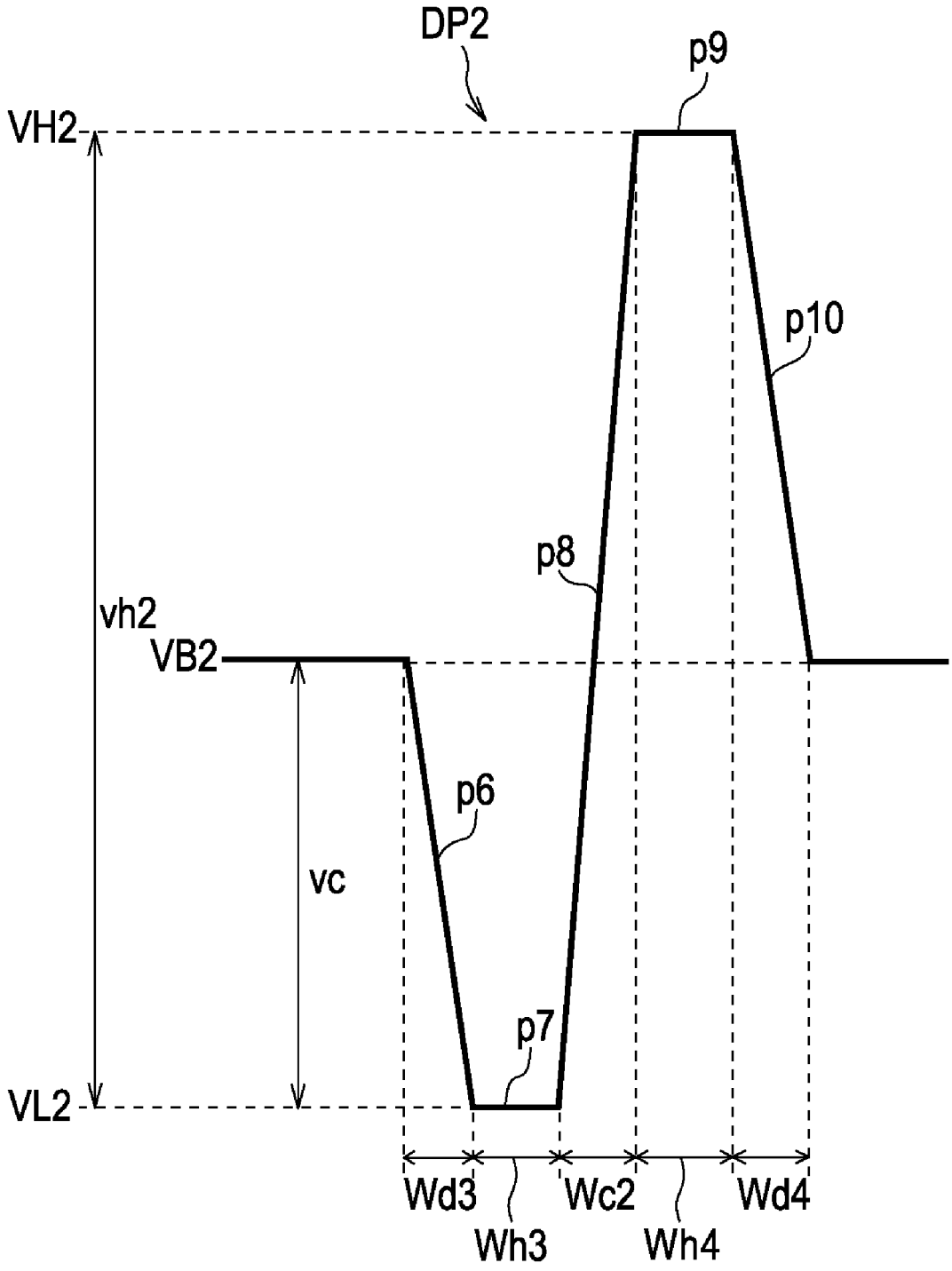
FIG. 8 is a waveform diagram illustrating a configuration of the ejection driving pulse according to a comparative example.

FIG. 5 is a waveform diagram illustrating a configuration of the driving signal COM1 containing the ejection driving pulse DP1 generated by the driving signal generating circuit 48 with the above-described configuration. FIG. 6 is a waveform diagram illustrating a configuration of the ejection driving pulse DP1. FIG. 7 is a waveform diagram illustrating a configuration of the driving signal COM2 containing the ejection driving pulse DP2 according to a comparative example. FIG. 8 is a waveform diagram illustrating a configuration of the ejection driving pulse DP2 according to a comparative example.

First, the ejection driving pulse DP2 (which is not a countermeasure) as the comparative example different from the ejection driving pulse DP1 (good waveform (which is provided as a countermeasure)) of the invention will be described. The ejection driving pulse DP2 is an example of the driving pulse that is generally used in the existing printer, and is an ejection driving pulse that ejects an ink droplet which is the biggest droplet that can be ejected from this kind of printer. The driving signal COM2 includes three ejection driving pulses DP2 (DP2*a*, DP2*b*, and DP2*c*) within the unit period determined by the LAT signal as shown in FIG. 7. As shown in FIG. 8, the second reference potential VB2 (corresponding to the middle potential) of the driving signal COM2 is adjusted to be 46% or less of the potential (the second contraction potential VH2) corresponding to the state where the piezoelectric oscillator 26 is displaced to the side of the pressure generating chamber 21 to contract the pressure generating chamber 21. In addition, the second expansion potential VL2 is the potential corresponding to the state where the piezoelectric oscillator 26 is displaced to the side opposite to the pressure generating chamber 21 to expand the pressure generating chamber 21.

The ejection driving pulse DP2 includes an expansion component p6 that changes the potential from the second reference potential VB2 to the second expansion potential VL2 while having a minus value (in the first direction) so as to expand the pressure generating chamber 21; an expansion holding component p7 that holds the second expansion potential VL2 for a predetermined time; a contraction component p8 that changes the potential from the second expansion potential VL2 to the second contraction potential VH2 while having a plus value (in the second direction) so as to abruptly contract the pressure generating chamber 21; a contraction holding (vibration suppressing) component p9 that holds the second contraction potential VH2 for a predetermined time; and a return component p10 that returns the potential from the second contraction potential VH2 to the second reference potential VB2.

In the ejection driving pulse DP2, the time interval Wd3 (for example, 2.67 μs) of the expansion component p6 is set to be shorter than the time interval Wh3 (for example, 3.23 μs) of the expansion holding component p7, the time interval Wd4 (for example, 3.00 μs) of the return component p10 is set to be shorter than the time interval Wh4 (for example, 3.42 μs) of the contraction holding component p9, and the second reference potential VB2 is set to be less than 50% (for example, 46%) of the second contraction potential VH2. That is, the ejection driving pulse DP2 includes a series of waveform components that cause a variation in the pressure, abruptly expanding the pressure generating chamber 21, inside the pressure generating chamber 21.

When the ejection driving pulse DP2 is applied to the piezoelectric oscillator 26, first, the piezoelectric oscillator 26 is distorted in a direction separating from the pressure generating chamber 21 by the expansion component p6, whereby the pressure generating chamber 21 is expanded from the reference volume corresponding to the second reference potential VB2 to the expansion volume corresponding to the second expansion potential VL2. Due to the expansion, the meniscus of the nozzle opening 28 is largely pulled toward the pressure generating chamber 21. Then, the expansion state of the pressure generating chamber 21 is held for the supply period (Wh3) of the expansion holding component p7. Subsequently, when the contraction component p8 is applied for the time interval Wc2 (2.89 μs), the pressure oscillator 26 is bent toward the pressure generating chamber 21. Due to the displacement of the piezoelectric oscillator 26, the pressure generating chamber 21 is abruptly contracted from the expansion volume to the contraction volume. Due to the abrupt contraction of the pressure generating chamber 21, the ink inside the pressure generating chamber 21 is pressurized, and the ink is ejected from the nozzle opening 28. The contraction state of the pressure generating chamber 21 is held for the supply period (Wh4) of the contraction holding component p9. Then, when the return component p10 is applied, the piezoelectric oscillator 26 is gently bent so as to separate from the pressure generating chamber 21, whereby the pressure generating chamber 21 returns from the contraction volume to the reference volume. As a result, a pressure vibration having a different phase (desirably, a reverse phase) from that of a residual vibration occurs, and hence the residual vibration is reduced. Then, when the ink is ejected by using the above-described ejection driving pulse DP1, a variation in the pressure inside the pressure generating chamber 21 is propagated inside the ink channel to thereby cause a negative pressure, which may cause cavitation inside the ink channel due to the negative pressure.

Next, the ejection driving pulse DP1 contained in the driving signal COM1 of the invention will be described.

As shown in FIG. 5, the driving signal COM1 includes three ejection driving pulses DP1 (DP1*a*, DP1*b*, and DP1*c*) within the unit period determined by the LAT signal. In addition, the first contraction potential VH1 is a potential that corresponds to the state where the piezoelectric oscillator 26 is displaced to the side of the pressure generating chamber 21 to thereby contract the pressure generating chamber 21, and the first expansion potential VL1 is a potential that corresponds to the state where the piezoelectric oscillator 26 is displaced to the side opposite to the pressure generating chamber 21 to thereby expand the pressure generating chamber 21.

The ejection driving pulse DP1 is an ejection driving pulse that ejects the largest ink droplet which can be ejected from the printer 1 of the embodiment. The ejection driving pulse DP1 includes an expansion component p1 (first changing portion) that changes the potential from the first reference potential VB1 (corresponding to the middle potential) to the first expansion potential VL1 while having a minus value (in the first direction) so as to expand the pressure generating chamber 21; an expansion holding component p2 (first holding portion) that holds the first expansion potential VL1 for a predetermined time; a contraction component p3 (second changing portion) that changes the potential from the first expansion potential VL1 to the first contraction potential VH1 while having a plus value (in the second direction) so as to abruptly contract the pressure generating chamber 21; a contraction holding (vibration suppressing) component p4 (second holding portion) that holds the first contraction potential VH1 for a predetermined time; and a return component p5 (third changing portion) that returns the potential from the first contraction potential VH1 to the first reference potential VB1. In other words, the ejection driving pulse DP1 includes an ejection portion having a waveform component (the expansion component p1 to the contraction component p3) for ejecting the ink from the nozzle opening 28; and a vibration suppressing portion having a waveform component (the contraction holding component p4 and the return component p5) for suppressing and stabilizing the residual vibration of the meniscus after the ink is ejected from the ejection portion.

When the ejection driving pulse DP1 of the invention is compared with the ejection driving pulse DP2, the reference potential values are different, and the settings for the time intervals of the respective waveform components are different. Specifically, the time interval Wd1 (3.67 μs) of the expansion component p1 is set to be longer than the time interval Wh1 (2.23 μs) of the expansion holding component p2, the time interval Wd2 (3.50 μs) of the return component p5 is set to be longer than the time interval Wh2 (2.82 μs) of the contraction holding component p4, and the first reference potential VB1 is set to be 50% or more (in the embodiment, 65% or more) of the first contraction potential VH1. In addition, the flow rate of the ink when ejecting the ink from the nozzle opening 28 by using the ejection driving pulse DP1 is 0.36 mg/s or more. That is, the ejection driving pulse DP1 includes a series of waveform components that cause a variation in the pressure, gently deforming the pressure generating chamber 21, inside the pressure generating chamber 21 so as to suppress the occurrence of cavitation due to the negative pressure generated inside the ink channel. In addition, the density of the ink of the embodiment is 1.06 g/cm$^3$. Further, the diameter of the nozzle of the embodiment is 22.5 μm (including a manufacturing error of ±1 μm or less).

When the ejection driving pulse DP1 is applied to the piezoelectric oscillator 26, first, the piezoelectric oscillator 26 is bent in a direction separating from the pressure generating chamber 21 by the expansion component p1, whereby the pressure generating chamber 21 is more gently expanded from the reference volume corresponding to the first reference potential VB1 to the expansion volume corresponding to the first expansion potential VL1 than the case where the expansion component p6 is applied to the piezoelectric oscillator 26 (first changing procedure). Due to the expansion, the meniscus of the nozzle opening 28 is largely pulled toward the pressure generating chamber 21. Then, the expansion state of the pressure generating chamber 21 is held for the supply period (Wh1) of the expansion holding component p2 (first holding procedure). Subsequently, when the contraction component p3 is applied for the time interval Wc1 (2.99 μs), the piezoelectric oscillator 26 is bent to the side of the pressure generating chamber 21. Due to the displacement of the piezoelectric oscillator 26, the pressure generating chamber 21 is abruptly contracted from the expansion volume to the contraction volume (second changing procedure). Due to the abrupt contraction of the pressure generating chamber 21, the ink inside the pressure generating chamber 21 is pressurized to thereby eject the ink from the nozzle opening 28. The contraction state of the pressure generating chamber 21 is held for the supply period (Wh2) of the contraction holding component p4 (second holding procedure). Then, when the return component p5 is applied, the piezoelectric oscillator 26 is more gently bent in a direction of separating from the pressure generating chamber 21 than the case where the expansion component p10 is applied to the piezoelectric oscillator 26, whereby the pressure generating chamber 21 returns from the contraction volume to the reference volume (third changing procedure). Accordingly, a pressure vibration having a different phase (desirably, a reverse phase) from that of a residual vibration occurs, and hence the residual vibration is reduced. Then, when the ejection driving pulse DP1 is applied to the piezoelectric oscillator 26, the flow rate when ejecting the ink from the nozzle opening 28 is 0.36 mg/s or more.

FIG. 9 is a diagram illustrating a relationship between a deaeration degree of the ink cartridge 3 and a dot skipping test result. In addition, in FIG. 9, "x" denotes the case where the ejection error occurs substantially in all the nozzle openings 28, "Δ" denotes the case where the ejection error occurs substantially in 80% of the nozzle openings 28, and "o" denotes the case where the ejection of all nozzle openings 28 is satisfactory.

As shown in the same drawing, when the ejection driving pulse DP2 (the lower end of FIG. 9) is applied to the piezoelectric oscillator 26, the ink is satisfactorily ejected from the nozzle opening 28 until two weeks (2 W saturation) from the time point when (immediately after) the ink cartridge 3 is attached to the printer 1. However, a so-called dot skipping in which the ink is not ejected from the nozzle opening 28 occurs after one month (1 M saturation) from the time point when the ink cartridge 3 is attached to the printer 1. On the other hand, when the ejection driving pulse DP1 (good waveform: the upper end of FIG. 9) is applied to the piezoelectric oscillator 26, the ink is satisfactorily ejected from the nozzle opening 28 until one month (1 M saturation) from the time point when (immediately after) the ink cartridge 3 is attached to the printer 1, and the ink is substantially satisfactorily ejected from the nozzle opening 28 until two months. Then, the ejection error occurs substantially in 80% of the nozzle openings 28 after three months (3 M saturation) from the time point when the ink cartridge 3 is attached to the printer 1. That is, in the case where the ejection driving pulse DP1 is applied to the piezoelectric oscillator 26, even when the amount of nitrogen dissolved in the ink inside of the ink cartridge 3 increases more than the case where the ejection driving pulse DP2 is applied to the piezoelectric oscillator 26, cavitation rarely occurs inside the ink channel.

Likewise, the ejection driving pulse DP1 of the printer 1 of the embodiment is the voltage waveform including the expansion component p1 that changes the potential from the first reference potential VB1 to have a minus value and to gently expand the volume the pressure generating chamber 21; the expansion holding component p2 that holds the volume of the pressure generating chamber 21 expanded by the expansion component p1 at the terminal potential VL1 of the expansion component p1 for a predetermined time; the contraction component p3 that changes the potential while having a plus value so as to contract the volume of the pressure generating chamber 21 expanded by the expansion component p1; the contraction holding component p4 that holds the volume of the pressure generating chamber 21 contracted by the contraction component p3 at the terminal potential VH1 of the contraction component p3 for a predetermined time; and the return component p5 that returns the potential to the first reference potential VB1 while having a minus value so as to gently expand the volume of the pressure generating chamber 21 contracted by the contraction component p3. The time interval Wd1 of the expansion component p1 is set to be longer than the time interval Wh1 of the expansion holding component p2, the time interval Wd2 of the return component p5 is set to be longer than the time interval Wh2 of the contraction holding component p4, and the first reference potential VB1 is set to be 50% or more of the potential VH1 of the contraction holding component p4. When the ejection driving pulse DP1 is applied to the piezoelectric oscillator 26, since the flow rate of the ink ejected from the nozzle opening 28 is 0.36 mg/s or more, it is possible to deform the pressure generating chamber 21 gently when a variation in the pressure is caused inside the pressure generating chamber 21 so as to eject the ink from the nozzle opening 28. Accordingly, it is possible to reduce the negative pressure generated inside the ink channel while ensuring the flow rate necessary for the ejection of the ink. Particularly, it is possible to reduce the negative pressure generated in a portion (boundary portion) where the flow rate becomes faster in accordance with a decrease in the sectional area of the channel of the supply port 30. Accordingly, since it is possible to suppress the occurrence of the cavitation caused by the negative pressure, it is possible to reduce the bubbles inside the ink channel with the occurrence of the cavitation. As a result, it is possible to suppress the occurrence of ejection errors such as the dot skipping caused by the bubbles staying inside the ink channel or the curved flying path.

In addition, even in the case where the amount of dissolved nitrogen of the ink cartridge 3 attached to the printer 1 is 7.0 ppm or more, it is possible to suppress the occurrence of cavitation caused by the negative pressure generated inside the ink channel when a variation in the pressure is applied to the pressure generating chamber 21. Accordingly, it is possible to suppress the occurrence of the ejection error caused by the bubbles inside the ink channel with the occurrence of the cavitation.

Further, in the above-described embodiment, the so-called deflection oscillation type piezoelectric element 26 is exemplified as the pressure generating unit, but the invention is not limited thereto. For example, a vertical oscillation type piezoelectric element may be adopted. In this case, the waveform has a potential of which the changing direction is reversed due to the relationship with the exemplified driving signals.

While the printer 1 as a kind of the liquid ejecting apparatuses has been exemplified, the invention may be applied to other liquid ejecting apparatuses. For example, the invention may be applied to a display manufacturing apparatus for manufacturing a color filter such as a liquid crystal display, an electrode manufacturing apparatus for forming an electrode such as an organic EL (Electro Luminescence) display or an FED (Field Emission Display), a chip manufacturing apparatus for manufacturing a biochip (biochemical element), and the like.

What is claimed is:

1. A liquid ejecting apparatus comprising:

a liquid ejecting head that applies a variation in the pressure to the inside of a pressure chamber by operating a pressure generating unit and ejects a liquid filled in the pressure chamber from a nozzle; and a driving signal generating unit that is capable of generating a driving signal containing an ejection driving pulse for ejecting the liquid from the nozzle to a landing target by driving the pressure generating unit, wherein the ejection driving pulse is a voltage waveform including:

a first changing portion that changes a potential from a middle potential in a first direction so as to change a volume of the pressure chamber;

a first holding portion that holds a terminal potential of the first changing portion so as to hold the volume of the pressure chamber for a predetermined time;

a second changing portion that changes the potential in a second direction opposite to the first direction so as to change the volume of the pressure chamber subjected to the first changing portion;

a second holding portion that holds a terminal potential of the second changing portion so as to hold the volume of the pressure chamber for a predetermined time; and a third changing portion that returns the potential to the middle potential in the first direction so as to change the volume of the pressure chamber subjected to the second changing portion, wherein a time interval of the first changing portion is longer than that of the first holding portion, wherein a time interval of the third changing portion is longer than that of the second holding portion, wherein the middle potential is set to be 50% or more of the potential of the second holding portion, and wherein when the ejection driving pulse is applied to the pressure generating unit, a flow rate of the liquid ejected from the nozzle is 0.36 mg/s or more.

2. The liquid ejecting apparatus according to claim 1, wherein the amount of nitrogen dissolved in a liquid filled in a liquid cartridge attached to the liquid ejecting apparatus is 7.0 ppm or more.

3. A control method of a liquid ejecting apparatus including: a liquid ejecting head that applies a variation in the pressure to the inside of a pressure chamber by operating a pressure generating unit and ejects a liquid filled in the pressure chamber from a nozzle; and a driving signal generating unit that is capable of generating a driving signal containing an ejection driving pulse for ejecting the liquid from the nozzle to a landing target by driving the pressure generating unit, the ejection driving pulse being a voltage waveform including: a first changing portion changing a potential from a middle potential in a first direction; a first holding portion holding a terminal potential of the first changing portion; a second changing portion changing the potential in a second direction opposite to the first direction; a second holding portion holding a terminal potential of the second changing portion; and a third changing portion returning the potential to the middle potential in the first direction, the middle potential being set to be 50% or more of the potential of the second holding portion, the control method comprising:

changing a volume of the pressure chamber by the first changing portion;

holding the volume of the pressure chamber subjected to the first changing portion for a predetermined time by the first holding portion;

changing the volume of the pressure chamber subjected to the first changing portion by the second changing portion;

holding the volume of the pressure chamber subjected to the second changing portion for a predetermined time by the second holding portion; and changing the volume of the pressure chamber subjected to the second changing portion by the third changing portion, wherein a time interval of the first changing is longer than that of the first holding, wherein a time interval of the third changing is longer than that of the second holding, and wherein a flow rate of the liquid ejected from the nozzle and subjected to the changing and holding is 0.36 mg/s or more.

* * * * *